US007841885B2

(12) United States Patent
Schmitt et al.

(10) Patent No.: US 7,841,885 B2
(45) Date of Patent: Nov. 30, 2010

(54) ELECTRICAL CONNECTOR HAVING IMPROVED RELEASABLE LOCKING MEANS

(75) Inventors: Gilles Schmitt, Senantes (FR); Sébastien Deubel, Longvilliers (FR)

(73) Assignee: FCI, Versailles (FR)

( * ) Notice: Subject to any disclaimer, the term of this patent is extended or adjusted under 35 U.S.C. 154(b) by 4 days.

(21) Appl. No.: 11/920,683

(22) PCT Filed: May 24, 2005

(86) PCT No.: PCT/EP2005/006497

§ 371 (c)(1),
(2), (4) Date: Jun. 30, 2009

(87) PCT Pub. No.: WO2006/125460

PCT Pub. Date: Nov. 30, 2006

(65) Prior Publication Data

US 2009/0298320 A1 Dec. 3, 2009

(51) Int. Cl.
*H01R 13/627* (2006.01)

(52) U.S. Cl. ..... 439/352; 439/923

(58) Field of Classification Search ..... 439/352, 439/357, 358, 152, 823, 350
See application file for complete search history.

(56) References Cited

U.S. PATENT DOCUMENTS 3,594,694 A 7/1971 Clark ..... 339/45 M
5,749,747 A * 5/1998 Inaba et al. ..... 439/358
5,848,912 A * 12/1998 Okabe ..... 439/489
5,919,056 A * 7/1999 Suzuki et al. ..... 439/352
5,938,470 A * 8/1999 Kashiyama ..... 439/489
6,102,726 A * 8/2000 Tsuji et al. ..... 439/352
6,146,183 A 11/2000 Jinno et al. ..... 439/358
6,241,542 B1 * 6/2001 Nishide et al. ..... 439/188
6,312,277 B1 11/2001 Holub ..... 439/352
6,341,973 B1 * 1/2002 Endo ..... 439/352
6,386,898 B1 * 5/2002 Taguchi ..... 439/352
6,524,125 B2 * 2/2003 Nakamura ..... 439/352
6,561,833 B2 * 5/2003 Saka et al. ..... 439/352
6,971,906 B2 * 12/2005 Yamaoka ..... 439/489
2004/0038569 A1 2/2004 Yamaoka et al. ..... 439/137
2005/0153594 A1 7/2005 Yamaoka ..... 439/352

FOREIGN PATENT DOCUMENTS

EP 0 887 891 A1 12/1998

* cited by examiner

*Primary Examiner*—T C Patel
*Assistant Examiner*—Harshad C Patel
(74) *Attorney, Agent, or Firm*—Harrington & Smith

(57) ABSTRACT

This connector has snap-fit lock including a partially deformable locking member which is mounted on the housing so as to be axially slideable between an extended locking position and a retracted position; and a biasing spring which axially bias said locking member to its locking position. The locking member has a flexible beam including a tooth member adapted to engage a complementary locking projection of the counterpart connector, and to provide an axial stop therewith. The flexible beam is elastically deflectable on the axial path of the locking member, whereby the snap-fit effect is provided by elastic load, both axial and in flexion, of the flexible beam.

12 Claims, 5 Drawing Sheets

ELECTRICAL CONNECTOR HAVING IMPROVED RELEASABLE LOCKING MEANS

BACKGROUND OF THE INVENTION

The invention relates to an electrical connector suitable to mate with a counterpart connector along a mating axis, and having an insulating housing and snap-fit locking means provided to releasably lock said housing onto a counterpart connector housing in a mated position, said locking means comprising a partially deformable locking member which is mounted on the housing so as to be axially slideable between an extended locking position and a retracted position, and biasing means which axially bias said locking member to its locking position.

Prior art connectors of this type have a recess formed in the housing, said recess being engageable by a complementary projection formed on a flexible beam of the counterpart connector housing. In such conventional connectors, the locking member is provided to lock the beam in the engaged position of the projection in the recess.

The connectors of this type, due to their locking means, are suitable for safety applications. However, their construction implies that both the connector equipped with the slideable locking member and the counterpart connector have deformable locking portions. The design of both connectors is thus specific to such safety applications, and both connectors are made more complex to manufacture.

SUMMARY OF THE INVENTION

It is an object of the invention to provide an electrical connector having safe locking means, which do not involve a specific design of the counterpart connector, and which particularly do not involve a flexible beam as a part of the counterpart connector.

Accordingly, the invention provides an electrical connector of the above-mentioned type, wherein the locking member has a flexible beam including a tooth member adapted to engage a complementary locking projection of the counterpart connector housing, and to provide an axial stop therewith in the locking position of the locking member, said flexible beam being elastically deflectable on the axial path of the locking member, whereby the snap-fit effect is provided by elastic load, both axial and in flexion, of the flexible beam.

The invention will be better understood on reading the following description of one particular embodiment of the invention, given as a non-limiting example.

DETAILED DESCRIPTION OF ONE PREFERRED EMBODIMENT

Figure 1:
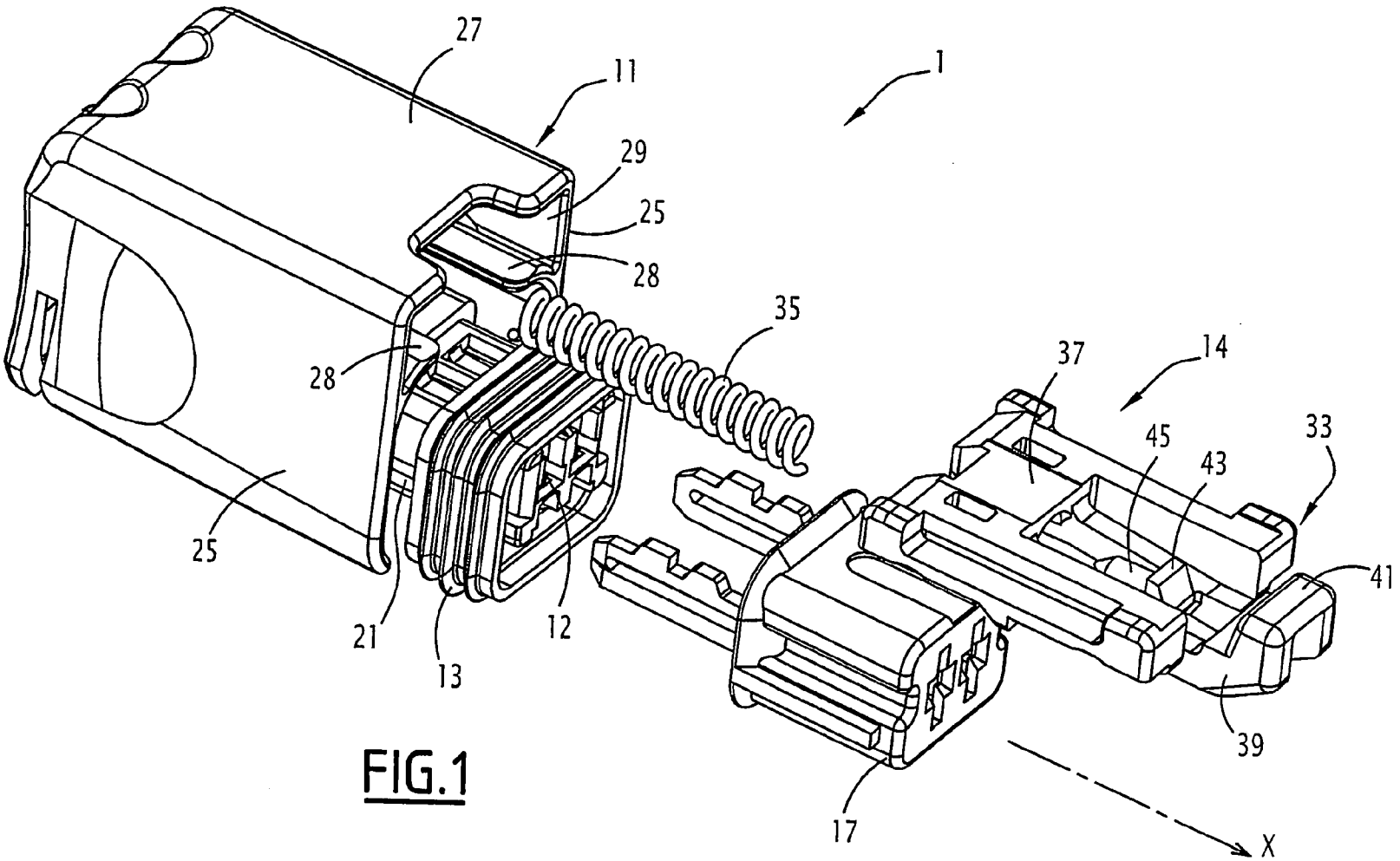
FIG. 1 is a perspective exploded view of an electrical connector of the invention.
Figure 2:
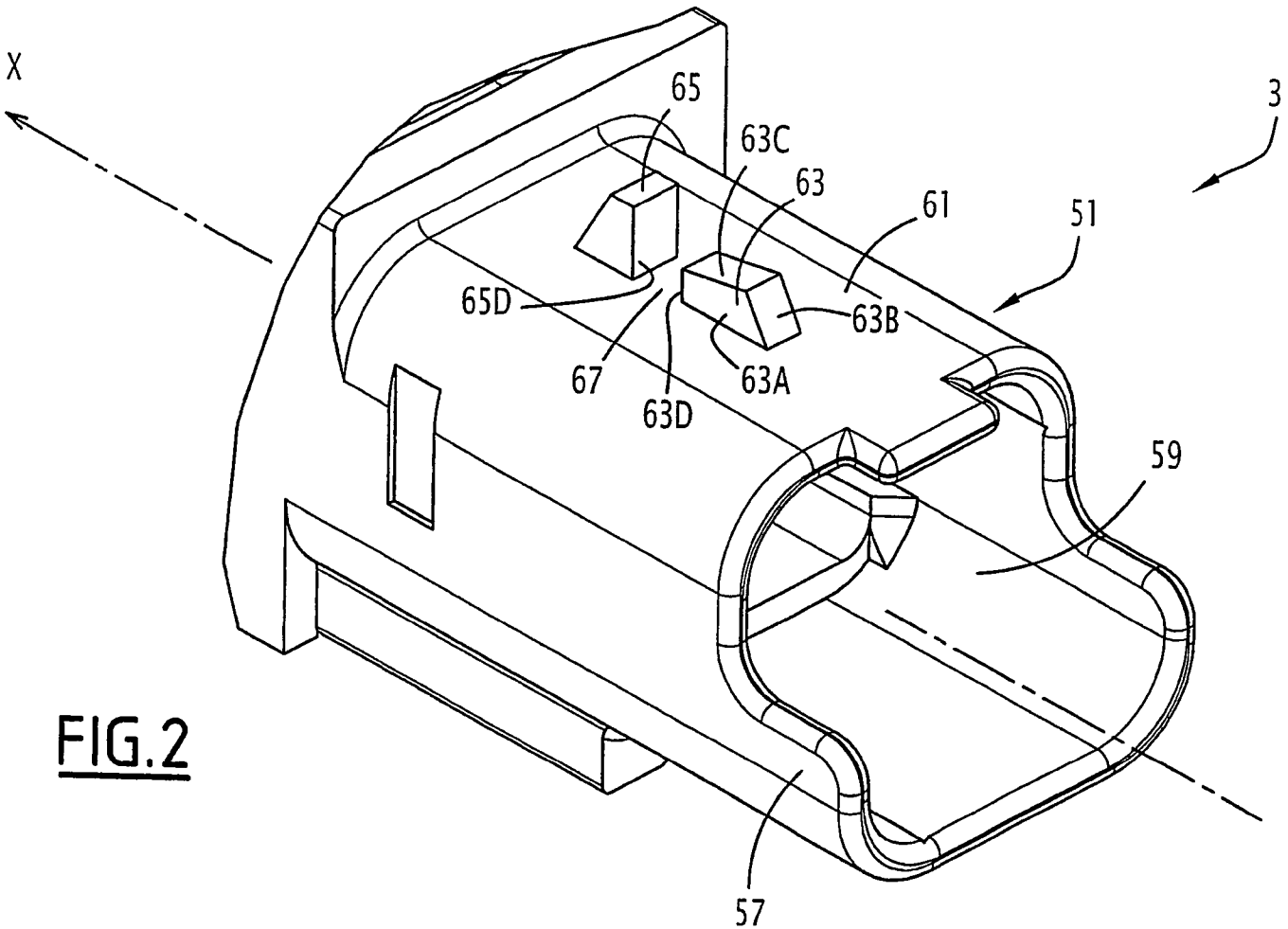
FIG. 2 is a perspective partial view of a counterpart connector of a conventional type, suitable for mating with the connector of the invention.

A connector 1 according to the invention is shown on FIG. 1 and a conventional counterpart connector 3 (a header in the illustrated example) is partially shown on FIG. 2.

These connectors 1, 3 define together a connecting device of a type used in an automotive application.

On the Figures, the X-axis represents the mating direction attached to the connector 1, and is oriented from the connector 1 towards the header 3 in mating conditions.

The orientation or position terms used in the present description, in particular the terms "forward" or "front", refer to this mating axis X.

Figure 3:
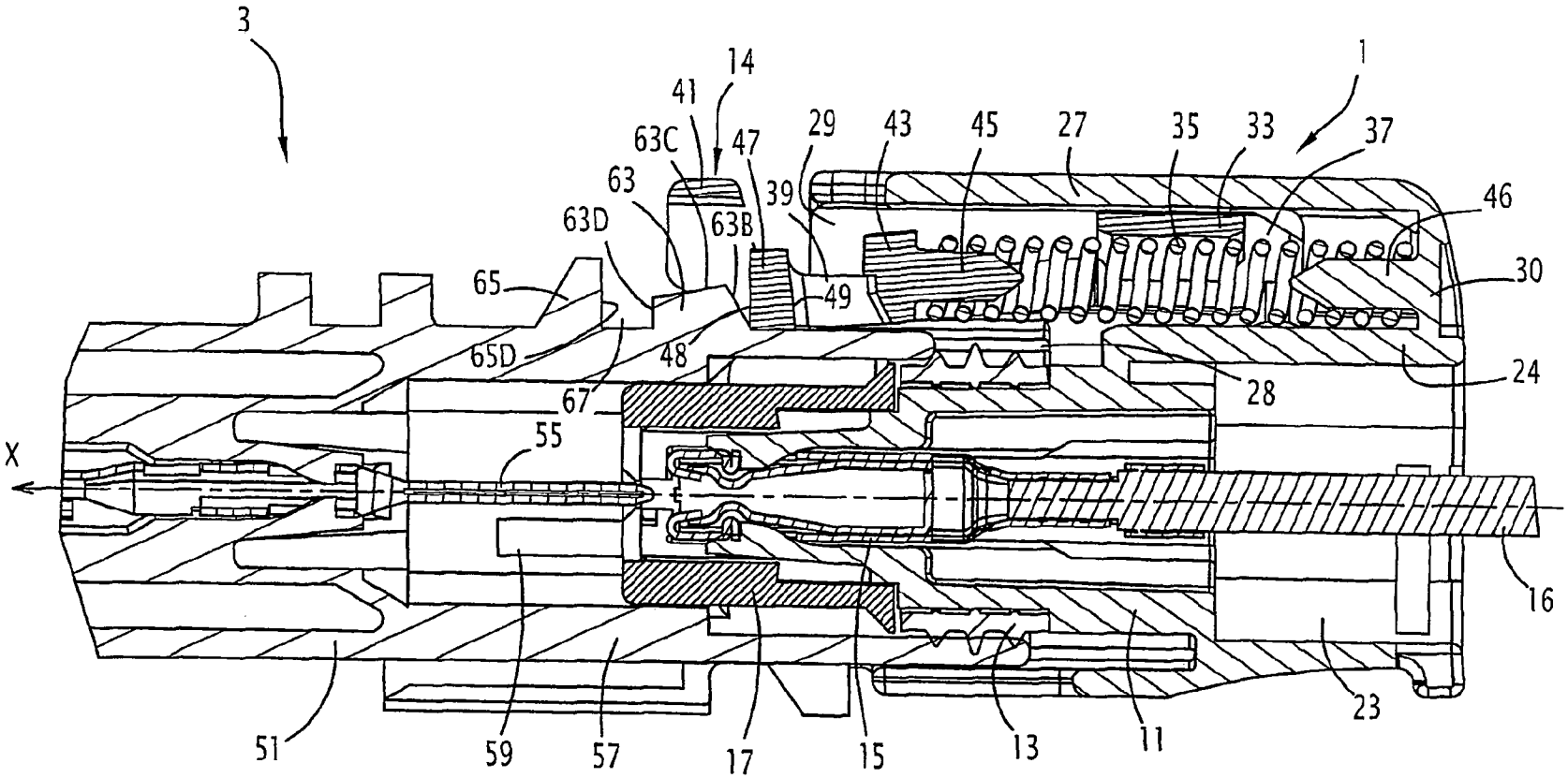
FIGS. 3 and 4 are sectional views, in an axial median plane of a terminal accommodating chamber, of the connectors of FIGS. 1 and 2, in two successive stages of partial mutual mating.
Figure 4:
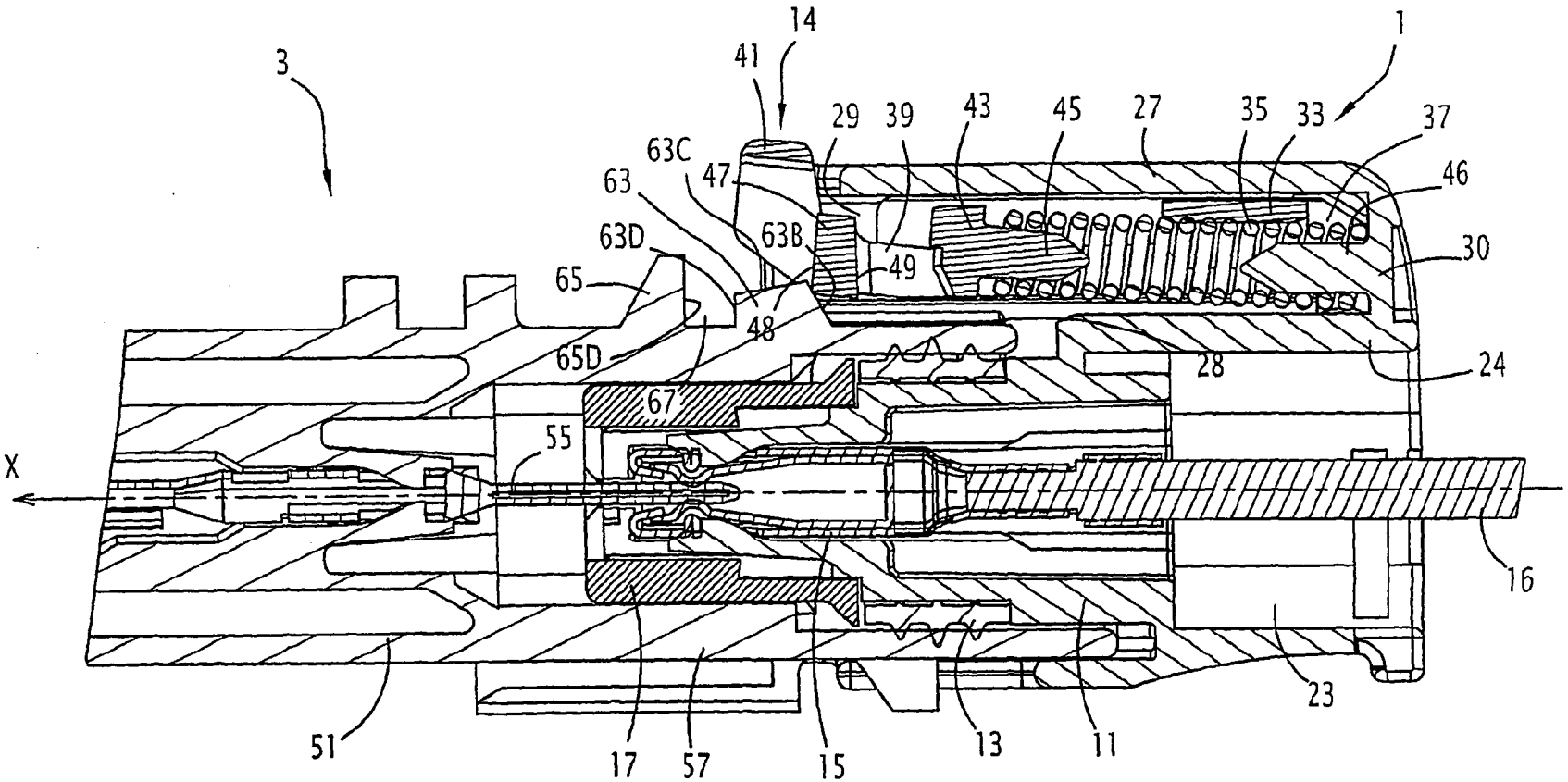
Figure 5:
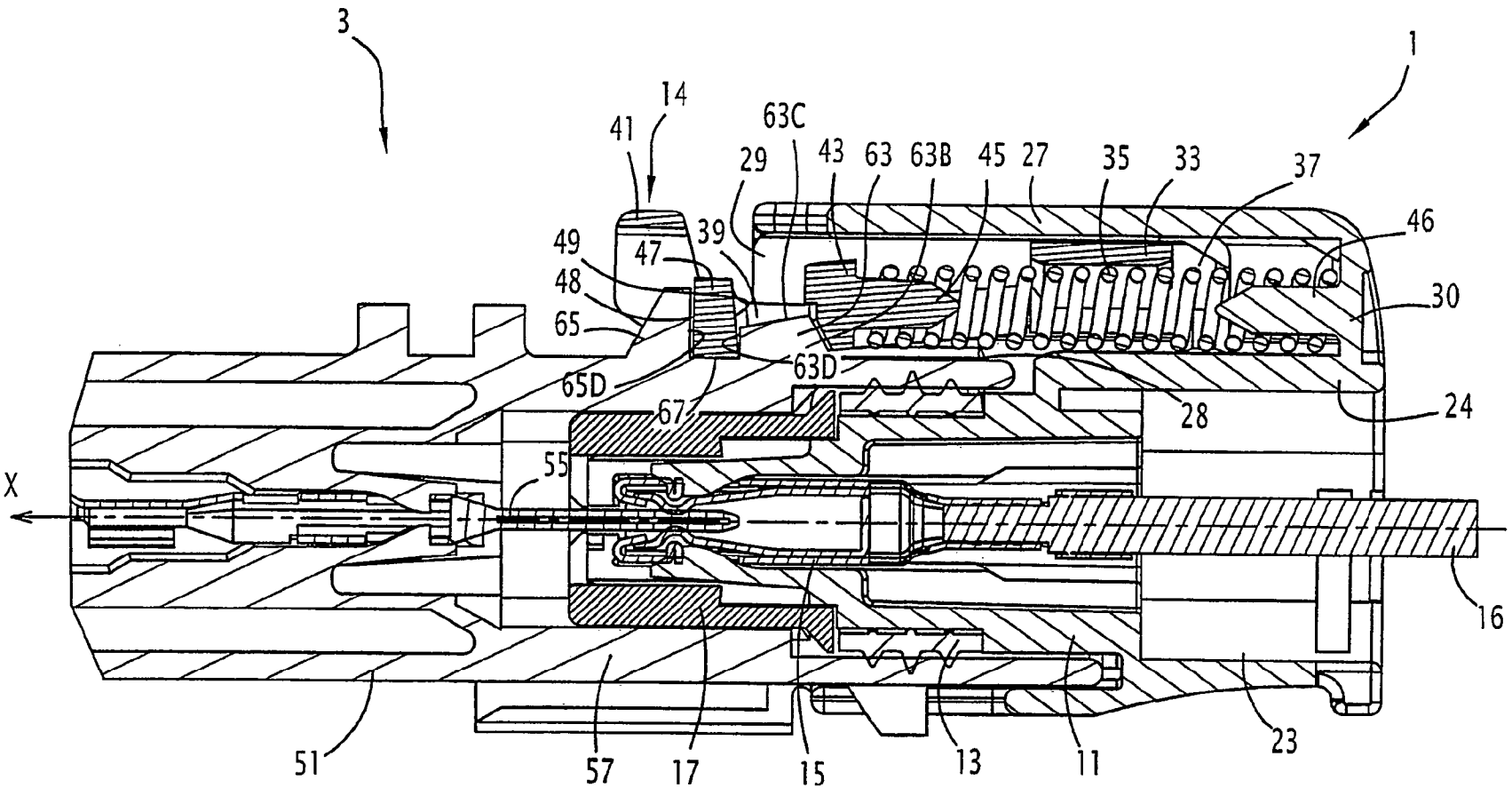
FIG. 5 is a similar view to FIGS. 3 and 4, in the complete mating state.

For the sake of clarity of the present description, the mating axis X is supposed horizontal, and the section plane of FIG. 3-5 is supposed vertical, though the connecting device may be used in any other orientation. The related terms of orientation or position, such as "above", "below", "upward", "downward", should also read accordingly.

The two-way connector 1 shown on the FIGS. 1 and 3-5 comprises an insulating housing 11, wherein a plurality of terminal accommodating chambers 12 are formed, a peripheral joint 13, and locking means 14, provided to releasably lock the connector onto the header 3.

The connector also comprises terminals 15 crimped at the end of respective wires 16, and fixedly arranged in respective accommodating chambers 12 of the housing 11 (FIG. 3-5). In the example shown, the terminals 15 are female terminals.

The connector also has a secondary locking device 17, which is mounted and fastened on a front section of the housing 11. Said secondary locking device is provided to ensure that the terminals 15 are in a proper functional position in their respective chambers 12, and provides a high retention force of the terminals in the respective chambers.

The housing 11 has a generally parallelepipedic front inner portion 21, wherein the accommodating chambers 12 are formed as through passages, and whereon the joint 13 is peripherally arranged.

The housing 11 also has a rear skirt 23, which is generally parallelepiped-shaped and which projects rearwards and outwards from the rear end of the front portion 21. The skirt 23 comprises one upper horizontal wall 24. The skirt 23 defines an inner recess, opened at the rear end, suitable for accommodating a grommet (not shown).

The housing comprises two vertical lateral walls 25, a horizontal upper wall 27, vertically spaced apart from the upper wall 24 of the skirt, and extending from the rear face of the housing to a mid section of the front portion 21.

Perpendicularly projecting inwardly from each lateral wall 25 is formed a horizontal plate 28, substantially coplanar with the skirt upper wall 24, which extends from the front side of the housing over a section of the front part 21. The plates 28 are parts of the housing 11 and transversally spaced one from the other.

The housing 11 is thus formed with an axial guide rail 29 defined by the hollow space comprised between the lateral walls 25, the upper wall 27, and the plates 28 together with the wall 24. The guide rail 29 is open at its front side, and closed at its rear side by a bottom wall 30. The locking means 14 are accommodated in the guide rail 29.

The housing 11 is preferably integrally made of a plastic material.

The locking means 14 include a locking member 33, and associated biasing means constituted, in the example shown, of an axial helical spring 35.

The locking member 33 is for example integrally made of a plastic material, and includes a slide member 37, which is adapted to be essentially non-deformable in normal use condition, and a flexible beam 39, which axially projects forwards from the slide member 37.

The flexible beam 39 has a free end at the front side, the locking member 33 being provided with an operating portion (or button) 41 at this free end.

At an intermediate section, the flexible beam 39 is formed with a stop member 43 suitable to be engaged by the forward end of the spring 35. The stop member 43 has a rearward axial projection 45, whereon the spring 35 can be fitted at the forward end thereof. In a corresponding manner, the bottom wall 30 is formed with a similar axial projection 46, oriented forwards, and whereon the spring 35 can be fitted at the rearward end thereof.

Between the stop member 43 and its free end, the flexible beam is provided with a tooth member 47, the cross-section of which, in the vertical plane of FIG. 3, is substantially rectangular with the front side 48 substantially vertical and the rear side 49 slightly inclined upwards with respect to the vertical direction.

The rear side or rear face 49 of the tooth member 47 defines an abutment face for providing the axial stop in the rearward direction, i.e. in the direction opposed to the mating direction, with a vertical face of a complementary locking projection (which will be described hereafter). Due to its slope, this abutment face 49 provides a wedge effect in the locking position, when engaged with the vertical complementary face.

When mounted on the housing 11, the locking means 14 are arranged in the guide rail 29 such that the locking member 33 can axially slide therein, with the axial spring 35 interposed between the stop member 43 and the bottom wall 30. The spring 35 is maintained in an axial position, bearing on the bottom wall 30 and on the stop member 43 when compressed, by virtue of the substantially aligned and opposed projections 45, 46.

The locking member 33 is axially biased to a neutral position in the guide rail 29 (neutral position shown on FIG. 3), where the button 41 and the tooth member 47 project forward therefrom, by compression of the spring 35.

The locking member 33 is stopped forward in the neutral position by adapted complementary stopping means (not shown), provided on the slide member 37 and in the guide rail 29. In the neutral position, the spring 35 is in a compressed preload state.

The neutral position also corresponds to the locking position of the locking member, when the connectors 1, 3 are mated.

While the slide member 37 is only axially displaceable in the guide rail 29, the beam 39 can be deflected upwards as far as the stop member 43 abuts the upper wall 27.

As shown on FIG. 2 to 5, the header 3, constituting a counterpart connector for the connector 1, essentially comprises an insulating housing 51 and a number of male terminals 55 corresponding to the female terminals 15.

The header 3 is for example suitable to be attached on an automotive equipment.

The housing 51 has a peripheral outer wall 57, defining an inner recess 59 wherein the male terminals 55 axially project, said recess 59 being designed to axially receive the front portion 21 of the complementary housing 11 upon mutual mating of both connectors 1, 3.

The peripheral wall 57 has a substantially flat, horizontal, upper surface 61, formed with a locking projection 63 and a stop projection 65. These projections 63, 65 are axially offset, and define a notch 67 therebetween, which is provided to receive the tooth 47 of the locking member in the locking position.

The projections 63, 65 are non-deformable in normal use conditions and particularly upon mating of the connectors 1, 3, whereby only the flexible beam 39 is deflected upon locking.

The locking projection 63 is made as a block having two opposed lateral faces 63A, which extend vertically and axially, and extending therebetween along the mating axis, a first inclined face 63B, a second inclined face 63C, and a vertical face 63D.

In the mating direction X attached to the connector 1, the first inclined face 63B slopes up from the flat surface 61, while the contiguous second inclined face 63C slopes down to the top edge of the vertical face 63D. The inclined faces 63B, 63D are thus reversely inclined and merge at a crest edge.

In the example shown, the first inclined face 63B has an inclination angle with respect to the vertical direction which is less than 40°, and more specifically of about 30°. The second inclined face 63C has an inclination angle with respect to the horizontal direction which is less than 30°, and more specifically of about 15°.

The vertical face 63D defines an abutment face for the rear face 49 of the tooth 47, providing an axial stop in the direction opposed to the mating direction X.

The stop projection 65 also has a vertical face 65D opposed to the face 63D, and which defines an abutment face for the front face 48 of the tooth 47, providing an axial stop in the mating direction X.

With reference to FIG. 3-5, it will now be described the way the locking means function upon mating of the connecting device 1, 3.

FIG. 3 illustrates a first stage of mating, where the front portion 21 of the housing 11 penetrates an entry section of the recess 59 of the complementary housing 51. In this position, a front lower edge of the tooth 47 comes into contact with the first inclined face 63B of the locking projection 63, at the base thereof.

It should be noted that the terminals 15, 55 do not come into mutual contact, whereby no electrical connection is made possible at this stage.

From this mating stage, when the insertion is continued, due to the inclination angle of the face 63B, the tooth 47 slides upwards on the inclined face 63B with compression of the spring 35 and flexion of the beam 39. Due to the compression of the spring 35 and the flexion of the beam 39, the insertion force is highly increased until the spring is released.

FIG. 4 illustrates a further stage of mating at the maximum compression state of the spring 35, where the tooth 47 reaches a top area of the first inclined face 63B, near the crest (or top edge). At this stage, the compression spring load is such high that it is enough for the tooth 47 to override the crest and come into its complete locking position.

The connection of the terminals 15, 55 is made possible from an intermediate mating position (not shown), comprised between the positions shown on FIGS. 3 and 4. Before reaching this position, the axial compressive load of the spring is not sufficient to overcome the insertion resistance applied by the projection 63 on the tooth 47, whereby the connector 1 is expelled from the header 3.

The connector 1 is thus either expelled from the header 3 without establishing any electrical connection, or forced to the complete locking position wherein the terminals 15, 55 are mutually engaged in their normal use position (connected position).

In other words, the connecting device 1, 3 has no stable incompletely mated position, where the electrical contact is established.

The complete locking position of the connecting device 1, 3 is shown on FIG. 5. In this position, which is the only stable connected position, the tooth 47 is engaged in the notch 67 and axially stopped between the vertical surfaces 63D, 65D. As mentioned before, the rear face 49 of the tooth abuts on the face 63D at its lower edge with a wedge effect due to its inclination.

In this position, the button 41 projects from the housing 11, such that it can be easily operated.

Before reaching the locked position shown on FIG. 5, from the position shown on FIG. 4, the tooth 47, together with the locking member 33, is pushed forward under the biasing load of the spring 35, such that the beam 39 is further deformed in flexion. The tooth 47 then passes the crest of the projection 63 and slides downwards on the face 63C. The inclination of this face 63C ensures that the tooth 47 can not stop thereon in a stable position.

The snap fit effect which biases the tooth 47 in the notch 67 is produced by both the spring compression and the beam flexion, that is by the elastic load of the beam 39 in flexion and in the axial direction.

Starting from the mated and locked position shown on FIG. 5, the connecting device 1, 3 may be released by raising the button 41 in such a way to disengage the tooth 47 from the notch 67, and by applying a separating axial effort on the housing 11, the header being retained in a fixed position.

The above described invention provides an increased robustness of the locking means, and a safe connection. It makes it possible to use state-of-art headers, with no change of the interface, whereby the invention involves few modifications of the existing connectors.

Another advantage of the invention consists in the sound click generated by the locking means upon the complete mating of the connectors, which constitutes an audible information of the state of the connecting device for the operator.

The invention claimed is:

1. An electrical connector suitable to mate with a counterpart connector along a mating axis (X), and having an insulating housing and snap-fit locking means provided to releasably lock said housing onto a counterpart connector housing in a mated position, said locking means comprising a partially deformable locking member which is mounted on the housing so as to be axially slideable between an extended locking position and a retracted position, and biasing means which axially bias said locking member to its locking position, wherein the locking member has a flexible beam including a tooth member adapted to engage a complementary locking projection of the counterpart connector housing, and to provide an axial stop therewith in the locking position of the locking member, said flexible beam being elastically deflectable on the axial path of the locking member, wherein the tooth member is configured to come into contact with the locking projection at a first stage of mating of the electrical connector to the counterpart connector to thereby compress the biasing means as the mating is continued.

2. The electrical connector as claimed in claim 1, wherein the housing has an axial guide rail, and the locking member has a slide member axially displaceable in the guide rail, the flexible beam axially projecting from the slide member in the mating direction (X).

3. The electrical connector as claimed in claim 1, wherein the locking member has an operating portion for releasing the locking member from its locking position, said operating portion projecting from the housing.

4. The electrical connector as claimed in claim 1, wherein the flexible beam has a free end oriented in the mating direction (X), and the tooth member is provided at said free end.

5. The electrical connector as claimed in claim 3, wherein the operating portion is provided at a free end of the flexible beam.

6. The electrical connector as claimed in claim 1, wherein the tooth member has an abutment face, providing the axial stop in the direction opposed to the mating direction (x) and a wedge effect with the complementary locking projection, when the locking member is in its locking position.

7. The electrical connector as claimed in claim 1, wherein the biasing means are interposed between the housing and the flexible beam.

8. An electrical connecting device comprising:

the electrical connector as claimed in claim 1, and a counterpart connector comprising a counterpart housing and a locking projection engageable by the tooth member.

9. The electrical connecting device as claimed in claim 8, wherein the locking projection is rigidly attached to the counterpart housing and substantially non-deformable upon mating of the connecting device.

10. The electrical connecting device as claimed in claim 9, wherein the locking projection of the counterpart connector has, along the mating axis (X), a first and a second reversely inclined faces, defining a crest edge therebetween, and an abutment face which is substantially perpendicular to the mating axis (X).

11. The electrical connecting device as claimed in claim 8, wherein the connector and the counterpart connector have respective terminals arranged in correspondence in the respective housings, such that a pair of corresponding terminals, upon mating of the connectors, come into electrical connection only once the biasing force applied by the biasing means on the locking member becomes greater than the elastic load necessary for the tooth member to engage the complementary locking projection in the complete locking position.

12. An electrical connector suitable to mate with a counterpart connector along a mating axis (X), and having an insulating housing and a snap-fit lock provided to releasably lock the insulating housing onto a counterpart connector housing of the counterpart connector in a mated position, wherein the lock comprises:

a partially deformable locking member which is mounted on the insulating housing so as to be axially slideable between an extended locking position and a retracted position; and a spring axially biasing the locking member to the extended locking position, wherein the locking member has a flexible beam including a tooth member adapted to engage a complementary locking projection of the counterpart connector housing, and to provide an axial stop therewith in the extended locking position of the locking member, wherein the flexible beam is elastically deflectable on an axial path of the locking member, wherein the tooth member is configured to come into contact with the locking projection at a first stage of mating of the electrical connector to the counterpart connector to thereby compress the spring as the mating of the electrical connector to the counterpart connector is continued past the first stage.

* * * * *